US005254970A

United States Patent [19]

Brady

[11] Patent Number: 5,254,970

[45] Date of Patent: Oct. 19, 1993

[54] PROGRAMMABLE PERSONAL ALARM

[76] Inventor: Edward T. Brady, 400 Central Park W., Apt. 14-P, New York, N.Y. 10025

[21] Appl. No.: 571,312

[22] Filed: Aug. 22, 1990

[51] Int. Cl.[5] ..... G08B 3/00; G08B 23/00

[52] U.S. Cl. ..... 340/328; 340/321; 340/574; 340/693; 340/692; 340/534; 340/528; 340/543

[58] Field of Search ..... 340/328, 321, 309.15, 340/574, 534, 535, 532, 546, 543, 573, 527, 528, 542; 361/171, 172; 380/693, 691, 692

[56] References Cited

U.S. PATENT DOCUMENTS 4,114,147 9/1978 Hile ..... 340/528
4,189,719 2/1980 Massa et al. ..... 340/528
4,404,549 9/1983 Berg ..... 340/321
4,520,351 5/1985 Altman et al. ..... 340/574
4,667,183 5/1987 Gaudio ..... 340/528
4,833,456 5/1989 Heller ..... 340/571

*Primary Examiner*—Donnie L. Crosland
*Attorney, Agent, or Firm*—Abdallah & Muckelroy

[57] ABSTRACT

A personal alarm device having programmable deactivating, apparatus. The device includes a keypad by which a personal numerical code can be entered. This code is the only manner by which the alarm of the device can be shut off once activated. The code can be changed only by a user knowing the previously-entered deactivation code.

2 Claims, 2 Drawing Sheets

PROGRAMMABLE PERSONAL ALARM

BACKGROUND OF THE INVENTION

The present invention generally relates to portable personal alarm devices. More specifically, this invention relates to personal alarm devices having selectively programmable means of activating and deactivating the alarm means of the device.

The personal alarm devices of the prior art have utilized various alarm activation and deactivation means. In U.S. Pat. No. 4,262,285 to Polley a spring-controlled lever actuator is used to control a pin disposed within the device that renders the device irreversibly activated. Key switch alarm deactivation means have also been used in the prior art. In U.S. Pat. No. 4,404,549 to Berg and U.S. Pat. No. 4,788,532 to Maldonado, conventional push button switches for alarm activation are combined with key-operated deactivation switching means. U.S. Pat. No. 4,665,389 to Clendening discloses a distress signaling device that includes alarm deactivation means that is controlled by removal of a waist belt secured about the user by means of a combination lock. In U.S. Pat. No. 4,520,351 to Altman et al. a passive personal alarm device is disclosed that includes an alarm deactivation means comprising a switch assembly having a plurality of switch settings, some of the settings being open settings and the remainder being closed settings, the closed settings being indistinguishable from the open settings by external examination of the device. Thereby deactivation is possible only by positioning the switch settings in an open setting pattern known only to the user. In U.S. Pat. No. 4,719,454 to Hopkins et al. a personal alarm device is disclosed having push button alarm activation means and alarm deactivation means operable by depression of a combination of push buttons as determined by the internal wiring of the deactivation circuit.

While these various inventions in the prior art have provided improvements in personal alarm devices, none provide the flexibility in control of the activation and deactivation means of a personal alarm as hereinafter described for the present invention.

SUMMARY OF THE INVENTION

The present invention is a personal alarm device that includes programmable alarm deactivation means thereby permitting the user to selectively enter a deactivation code by which the alarm can be deactivated. The deactivation code can be changed only by a user knowing the previously entered code. An integrated circuit is disclosed that is operable in four distinct modes: a coding mode, a verifying mode, a deactivation mode and a re-coding mode.

An object of this invention is to provide a personal alarm device that can be carried by the user.

Another object of this invention is to provide a personal alarm device that can be secretly programmed with an alarm deactivation code known only to the user.

A still further object of the present invention is to provide a programmable personal alarm device having programming means that permit an alarm deactivation code to be selectively changed by only an authorized user.

These and other objects and advantages of the present invention will be apparent to those skilled in the art from the following description of a preferred embodiment, claims and appended drawings.

DESCRIPTION OF A PREFERRED EMBODIMENT

Figure 1:
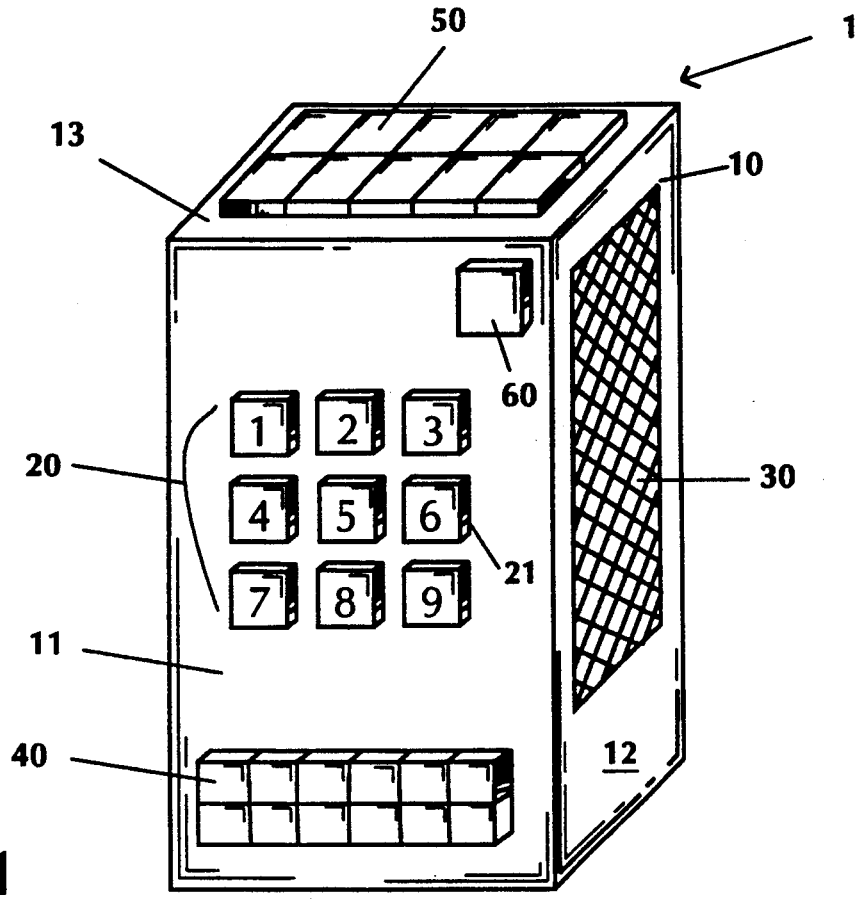
FIG. 1 is a front perspective view of the personal alarm device of the present invention.

FIG. 1 illustrates in a front perspective view the personal alarm device 1 of the present invention. The device 1 generally comprises a hollow housing member 10 having a numerical keypad 20 disposed in its forward face 11, a speaker 30 disposed in a side wall 12, a first panic strip 40 disposed on the forward face 11 of the housing member 10 below said numerical keypad 20 and a second panic strip 50 disposed on the top wall 13 of the housing member 10. A program button 60 is disposed on the forward face 11 of the housing member 10 adjacent to the numerical keypad 20. The keypad 20 preferably includes nine keys 21 which are numbered 1 through 9 for programming purposes as will be better understood in view of the description device operation of hereinafter. The keys 21, program button 60 and panic strips 40, 50 are switching means that are normally open. They are spring loaded and upon release assume automatically a normal position.

Figure 2:
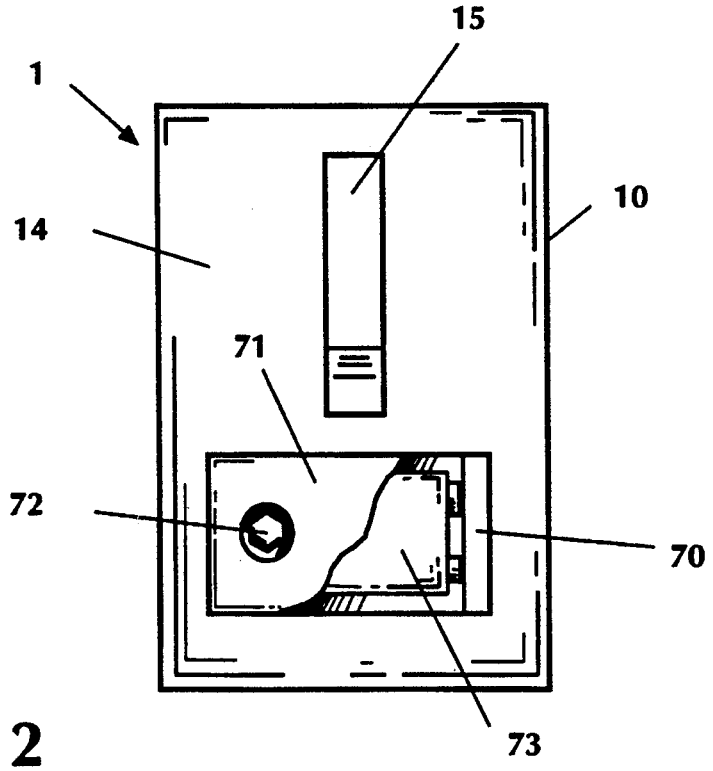
FIG. 2 is a rear plan view of the invention.

As can be seen in the rear plan view of the device 1 illustrated in FIG. 2 a battery compartment 70 having a compartment door 71 to selectively seal said battery compartment 70 is disposed in the rear wall 14 of said housing member 10. The battery compartment door 71 is preferably secured to said housing member 10 by means of tamper-resistant recessed screw means 72. A pocket clip 15 is integrally formed with the rear wall 14 of said housing 10 for selective attachment of the device 1 to a pocket or the like. The device 1 is preferably made operable by one or a plurality of batteries 73, for example a 9-volt battery, which is stored in said battery compartment 70.

Figure 3:
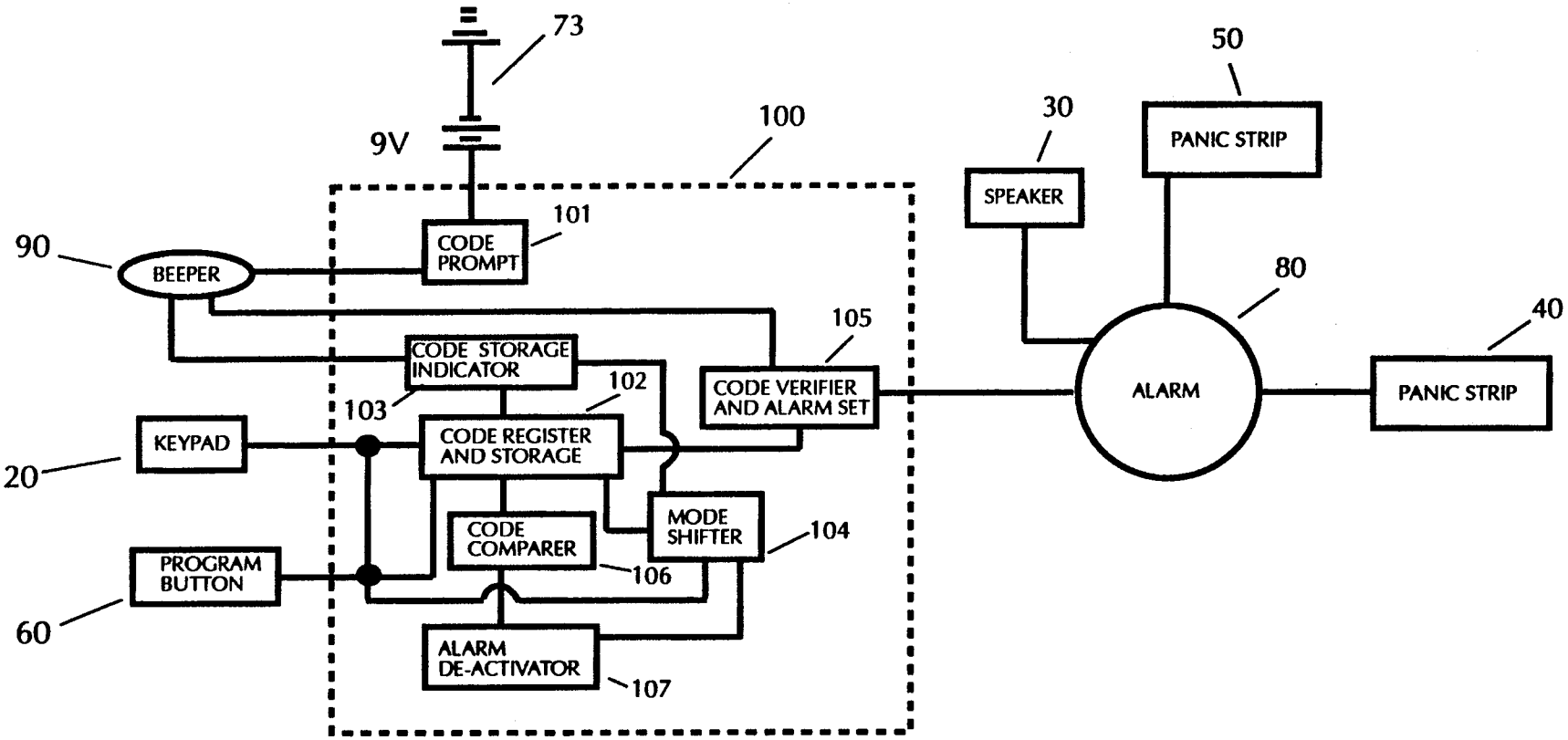
FIG. 3 is a block diagram of the electrical circuitry of the present invention.

A block diagram of the electrical circuitry of the present device 1 is illustrated in FIG. 3 where it can be seen that the device further includes an alarm 80 which communicates with said speaker 30 and the panic strips 40, 50, and a beeper 90. While the preferred embodiment of the device 1 includes a beeper, i.e. an audible sound device, visual or tactile indicating means may be utilized for its purposes. The alarm 80 and the beeper 90, as well as the keypad 20 and program button 60, also communicate with a micro-chip 100. The micro-chip 100 is preferably a programmable, non-erasable micro-chip 100, for example micro-chip Model No. 8051 manufactured by Intel Corp., and provides operation and control means for the device 1. The micro-chip 100 is programmed at the chip production facilities for operation as hereinafter described.

When the battery 73 is initially placed in the compartment 70 and connected to the micro-chip 100, code prompt means 101 in the micro-chip 100 causes the beeper 90 to give one beep. This indicates to the user that the device 1 is ready for receipt of a deactivation code. After the one beep by the beeper 90 the deactivation code is entered by depressing in sequence individual keys 21 of the keypad 20. The deactivation code entered by the user is totally at the user's discretion, however, the code preferably should be a number sequence that can be easily remembered by the user, such as a birth date address, etc. Upon completing entry of the code the program button 60 is depressed. The keypad 20 communicates with code register and storage means 102 in the micro-chip 100 which is operable in four distinct modes of operation: a coding mode, a verifying mode, a deactivating mode and a re-coding mode. Initially the code register and storage means 102 is set in the coding mode and when the deactivation code is entered via the keypad 20 the code register and storage means 102 reads the deactivation code entered and registers the code therein. When the program button 60 is depressed the entered code is stored in the code register and storage means 102. The code register and storage means 102 communicates with a code storage indicator 103 which is activated by depressing the program button 60 following entry of a deactivation code, that is, when the code is stored. The code storage indicator 103 causes the beeper 90 to give two beeps which indicates to the user that the deactivation code has been stored in the code register and storage means 102. The code storage indicator 103 communicates with a mode shifter 104 which shifts the code register and storage means 102 from the coding mode to the verifying mode when the code storage indicator 103 is activated. The mode shifter 104 is also capable of distinguishing the order in which the keypad 20 and program button 60 are pressed and functioning differently to change the deactivation code as hereinafter described in greater detail.

The code register and storage means 102 is now in the verifying mode and to verify the code entered, the deactivation code is again entered via keypad 20. A code verifier and alarm set means 105 communicates with the code register and storage means 102 and if the correct code has been entered the code verifier and alarm set means 105 causes the beeper 90 to give three beeps, which verifies to the user the code entered, and sets the alarm 80. Upon setting the alarm 80 the code verifier and alarm set means 105 causes the mode shifter 104 to shift the code register and storage means 102 from the verifying mode to the deactivating mode. If an incorrect code is entered the code verifier and alarm set means 105 does not activate the mode shifter 104 but instead causes the beeper 90 to give one long, continuous buzz, which indicates to the user that the code register and storage means 102 remains in the verifying mode ready to again verify the entered code.

When the alarm 80 is set the code register and storage means 102 is in the deactivating mode. In an emergency situation the alarm 80 can now be activated by depressing either the first panic strip 40 or the second panic strip 50. To deactivate the alarm 80 the deactivation code is entered via keypad 20. A code comparer 106 communicates with the code register and storage means 102 and alarm deactivation means 107. The code comparer 106 compares the entered code with the code stored in the code register and storage means 102 and if the correct code is entered the code comparer 106 activates the alarm deactivation means 107 which causes the alarm 80 to shut off and reset. The same deactivation code is still effective for subsequent use.

The mode shifter 104 is also capable of recognizing whether the program button 60 is depressed before the deactivation code is entered via the keypad 20. This function of the mode shifter 104 permits the deactivation code to be changed by the user. To change the deactivation code the program button 60 is depressed first which causes the mode shifter 104 to shift the code register and storage means 102 to the re-coding mode. The current deactivation code is then entered via keypad 20 and the program button 60 is depressed again. The code register and storage means 102 reads the entered code and the code comparer 106 compares the current deactivation code with the entered code. If the current code and the entered code are the same the code register and storage means 102 cause the beeper 90 to give two beeps. The new deactivation code is now entered via keypad 20 and the program button 60 is depressed to store the new code in the code register and storage means 102 and shift the code register and storage means 102 to the verifying mode. The new code is then verified as heretofore described.

The preferred embodiment of the device 1 is illustrative of the present disclosure and is not intended to be limiting. Various changes and modifications of the personal alarm device 1 of the present invention may be made without departing from the spirit and scope of the disclosure. For example, the code comparer 106 and code verifier and alarm set means 105 may be combined into a single means without departing from the spirit and scope of this invention. Furthermore, the keypad may be numerical or alphabetic or a combination thereof. Such changes and modifications within the coverage of the language of the claims hereinafter recited are intended to be included as part of the present disclosure.

Therefore, in view of the foregoing I claim:

1. A portable personal alarm device comprising a hollow housing member;

a battery disposed in said housing member;

a beeper disposed in said housing member, said beeper being provided to emit one or a plurality of sequentially discrete sounds;

first prompting means to indicate that said device is ready to receive a code, said first prompting means being connected to said battery and said beeper, said first prompting means being response to the flow of electricity from said battery to cause said beeper to emit one discrete sound;

code entering means disposed on a face of said housing member;

code register and storage means to register and store a code, said code register and storage means being disposed in said housing member and connected to said code entering means, said code register and storage means being selectively operable in a coding mode for registering and storing a first code, a verifying mode for verifying a registered and stored code, a deactivating mode for deactivating an alarm means and a re-coding mode for registering and storing a second code, said code register and storage means being initially set in the coding mode;

code storage activating means disposed in said housing member and connected to said code entering means and to said code register and storage means to activate storing of a code in said code register and storage means in said coding mode;

code storage and prompting means to indicate the storage of the first code in said code register and storage means, said code storage and prompting means including a code storage indicator, said code storage indicator being connected to said code register and storage means and to said beeper, said code storage indicator being operable in the coding mode of said code register and storage means to cause said beeper to emit a first plurality of discrete sounds;

first mode shifting means to shift the operation of said code register and storage means from the coding mode to the verifying mode, said first mode shifting means being responsive to operation of said code storage indicator;

code verifying and alarm setting means to verify the first code entered via said code entering means and to set alarm means, said code verifying and alarm setting means being connected to said code register and storage means and to said beeper, said code verifying and alarm setting means being operable in the verifying mode of said code register and storage means to cause said beeper to emit a second plurality of discrete sounds;

second mode shifting means to shift the operation of said code register and storage means from the verifying mode to the deactivating mode, said second mode shifting means being responsive to the operation of said code verifying and alarm setting means;

second prompting means to indicate the verification of said first code entered and the setting of said alarm means, said second prompting means being connected to said code verifying and alarm setting means;

alarm means connected to said code verifying and alarm setting means and to said battery, said alarm means being provided to emit a continuous sound;

alarm activating means to activate said alarm means, said alarm activating means being connected to said alarm means; and alarm deactivating means to selectively deactivate said alarm means, said alarm deactivating means being connected to said code entering means and to said alarm means.

2. A portable personal alarm device comprising a hollow housing member;

programmable alarm sounding means disposed in said housing member to selectively program operation of an alarm;

an alarm connected to said programmable alarm sounding means;

first and second alarm activating means to selectively activate said alarm, said first and second alarm activating means being connected to said alarm and respectively disposed on distinct and displaced portions of said housing member thereby facilitating activation of said alarm from a variety of bodily positions;

said programmable alarm sounding means comprising a programmable, non-erasable micro-chip disposed in said housing member, said mocro-chip including (a) code register and storage means to register and store a code entered via a keypad, (b) code verifying means to verify entry of said code, said code verifying means being connected to said keypad and said code register and storage means, (c) alarm setting means to set an alarm, said alarm setting means being connected to said code register and storage means and said alarm, (d) alarm deactivating means to deactivate said alarm after being activated by operation of either said first or second alarm activating means, (e) mode shifting means connected to said code register and storage means to automatically shift operation of said micro-chip between a coding mode, a verifying mode, a deactivating mode and a re-coding mode;

a keypad disposed in said housing member and communicating with said micro-chip;

a program button disposed in said housing member and communicating with said micro-chip;

a speaker disposed in said housing member and communicating with said alarm;

said alarm being disposed in said housing member and communicating with said first and second alarm activating means, said speaker and said micro-chip.

* * * * *